United States Patent [19]

Burke et al.

[11] Patent Number: 4,805,273

[45] Date of Patent: Feb. 21, 1989

[54] SNAP FASTENER FOR MOLDING ON TO FABRIC AND APPARATUS FOR MAKING IT

[75] Inventors: James E. Burke, Huntington; Robert J. Zavatkay, Torrington, both of Conn.

[73] Assignee: Scovill Fasteners Inc., New York, N.Y.

[21] Appl. No.: 127,958

[22] Filed: Dec. 2, 1987

[51] Int. Cl.[4] ..... A44B 17/00

[52] U.S. Cl. ..... 24/662; 24/104; 24/621

[58] Field of Search ..... 24/620, 621, 624, 623, 24/662, 664, 665, 666, 680, 681, 682, 667, 104, 106, 107, 108

[56] References Cited

U.S. PATENT DOCUMENTS

| | | | |
|---|---|---|---|
| 720,616 | 2/1903 | Pringle | 24/621 |
| 1,432,660 | 10/1922 | Bourque | 24/681 |
| 2,300,292 | 10/1942 | Jones | 24/681 |
| 2,895,199 | 7/1959 | Jones | 24/662 X |
| 3,551,963 | 1/1971 | Mosher Jr. et al. | 24/662 X |
| 3,643,296 | 2/1972 | Kahn | 24/108 |
| 4,350,656 | 9/1982 | Moertel | 264/166 |
| 4,539,735 | 9/1985 | Kasai | 24/691 X |
| 4,562,624 | 1/1986 | Kanzaka | 24/691 X |

FOREIGN PATENT DOCUMENTS

| | | | |
|---|---|---|---|
| 268500 | 10/1963 | Australia | 24/662 |
| 698647 | 11/1964 | Canada . | |
| 2303484 | 8/1973 | Fed. Rep. of Germany . | |
| 483555 | 7/1917 | France | 24/623 |
| 572154 | 9/1945 | United Kingdom | 24/623 |
| 1171481 | 11/1969 | United Kingdom | 24/662 |
| 1229656 | 4/1971 | United Kingdom | 24/666 |

*Primary Examiner*—Kenneth J. Dorner
*Assistant Examiner*—Laurie K. Cranmer
*Attorney, Agent, or Firm*—Dallett Hoopes

[57] ABSTRACT

A plastic molded snap fastener including a stud head having solid thin annular base flange and a top, the top and the flange being held in spaced relation by radial ribs preferably in the form of a cross piece, the top being annular but "flattened" on the outer perimeter in the area of the ends of the cross piece. Where the plastic is compatible with the plastic of the fabric, the fastener parts may be molded directly on the fabric. In a modification the base flange is split by a plane perpendicular to the axis of the fastener part. The base fabric is sandwiched between the parts of the flange. This modification is useful where the plastic of the fastener is not compatible with the plastic of the fabric. The invention also includes a mold apparatus for forming the fastener on a stip of fabric wherein core pins on one side of the mold cooperate with spring-pressed ejection pins on the other side and with cavities in the mold retainer plates to shape the parts. The preferred mold apparatus also includes punches for perforating the fabric preparatory to the molding operation.

14 Claims, 4 Drawing Sheets

SNAP FASTENER FOR MOLDING ON TO FABRIC AND APPARATUS FOR MAKING IT

BACKGROUND OF THE INVENTION

1. Field of the Invention

This invention relates to a plastic molded snap fastener the parts of which may be molded directly on to a reinforced disposable-type fabric and to an apparatus for doing such molding.

2. Description of the Related Art Including Information Disclosed under §§1.97–1.99

The prior art discloses plastic molded fasteners and processes and apparatus for making them. An example is disclosed in Canadian patent 698,647, which issued Nov. 24, 1964 to James R. Jenness, Jr. (A copy is enclosed in accordance with § 1.97.) In accordance with this patent a disposable reinforced fabric is clamped between the plates of a mold, the mold closed, and plastic literally "blown through" the fabric to fill the cavities of the mold. The result is a fastener molded on to the fabric. In forming the head element of the snap fastener, side plates come into play to shape the neck of the head. After cooling, the mold is opened and the side plates are parted, and the fastener, now secured to the fabric, is taken from the mold apparatus. In forming the socket element under the Canadian patent, a circular patch is molded on to the fabric and, after molding, the patch is centrally perforated to form a socket.

Other examples of fasteners molded on to disposable fabric are shown in the German publication 2,303,484, which was laid open Aug. 9, 1973, and the U.S. Pat. No. 4,350,656, which issued to George Moertel on Sept. 21, 1982. (Copies of these documents are also enclosed in accordance with §1.97.)

SUMMARY OF THE INVENTION

The present invention contemplates a snap fastener molded on to disposable fabric and an apparatus for making it, and provides a superior product and an apparatus which offers greater freedom in spacing of the fastener parts on the fabric and speed of operation.

More specifically, the fastener itself, under the present invention, includes a stud head having a base flange which is provided with radial ribs for greater stability and a top of the head portion which is cored out and flattened adjacent the ends of the ribs. This shaping assures that the relative stiffness of the ribs will not affect the action and thus assures constant on/off action irrespective of the angle from which the two fastener elements, the stud head and socket, are pushed together or pulled apart.

The socket element is molded in a specific shape and has dimensions of exact measurement so that its action will be more predictable, as opposed to the socket of the Canadian patent, which is punched rather than shaped.

In a modified version of the fastener designed specifically for fabric which is not compatible with the plastic of the fastener elements, a special base flange is provided having spoked-wheel-like shape with the wheel axially split so that its two layers sandwich between them the disposable fabric to make a more mechanical clamping action rather than a bonded one, as with the preferred embodiment.

Adding to all of the above is the apparatus of the invention, which includes a mold having core pins which, during molding, engage spring-pressed ejection pins. These parts combine with the mold cavities to shape the individual fastener elements. When the mold is opened, the ejection pins snap the molded elements out of the mold so that the fabric can move on to its next station. The apparatus also preferably includes punch means which, when the mold is closing, perforate the fabric so that later when the mold is open and the fabric advanced, the mold can then be closed over the perforations to form the fastener elements as described above.

Because the apparatus of the invention does not require side plates in forming the stud head, as in the Canadian patent, and because it provides for a shaped socket, a superior product can be made in a much shorter molding time. Further, because there are no side plates, fastener elements can be molded closer together.

BRIEF DESCRIPTION OF THE DRAWINGS

Other features and objects of the invention will be apparent from the following specification and the drawings, all of which disclose non-limiting embodiments of the invention. In the drawings.

DESCRIPTION OF THE PREFERRED EMBODIMENT

Figure 1:
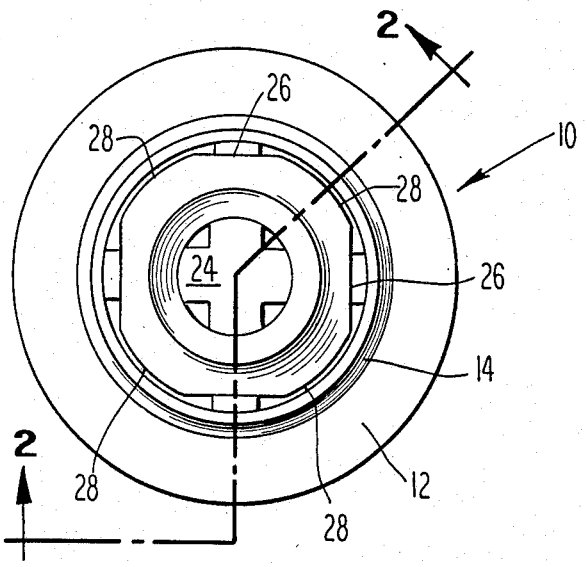
FIG. 1 is a top view of a fastener head element embodying the invention.

A preferred embodiment of fastener is shown in FIG. 1 and generally designated 10. It comprises an annular base flange 12 having on its inner perimeter a thickened ring 14 for the purpose of giving strength to the product and for assisting the flow of plastic during the molding operation. The top 16 of the head element is provided with a curved outer periphery 18 adapted to assist in the mating operation. The top is formed with a central opening 20 having an inwardly and downwardly inclined inner periphery 22.

Figure 2:
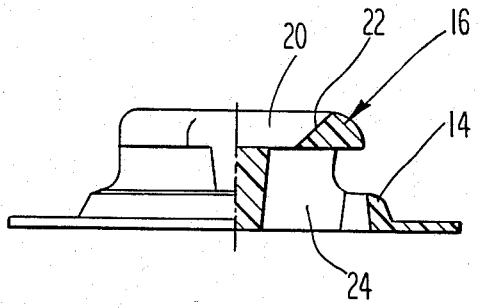
FIG. 2 is a combined side view and sectional view taken on the line 2—2 of FIG. 1.

Connecting the top 16 and the base 12 are radial ribs in the form of cross pieces 24, which are formed across the ring 14 and intersect centrally of the element (FIG. 1). Preferably the cross elements are of trapezoidal cross section, as shown best in FIG. 2, and the upper surfaces of the outer portions of the cross pieces engage the top 16. The radial ribs need not extend all the way to the center of the stud, but the version shown is preferred.

Because it has been found that the action of the fastener would be less predictable if the top and cross pieces were permitted to extend all the way to the circle defined by the outer perimeter of the top, both the cross pieces and the top are foreshortened as at 26 to form what might be regarded as "flats" at each of the four 90-degree points on the circle of the top. Thus, the actual socket-mouth-engaging portions of the top of the head are the curved portions 28 of the top intermediate "flats" 26.

Figure 3:
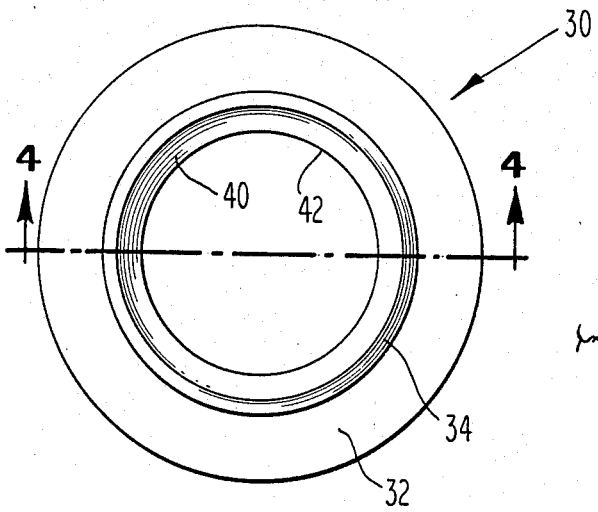
FIG. 3 is a top view of a socket embodying the invention.
Figure 4:
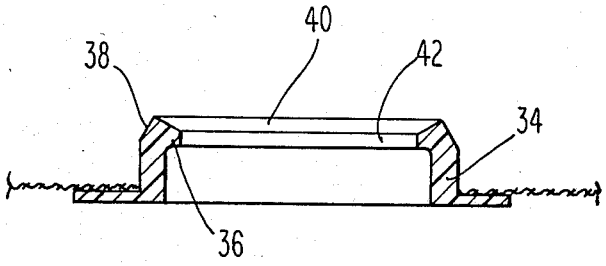
FIG. 4 is a sectional view taken on the line 4—4 of FIG. 3.

FIG. 3 is a view showing a socket embodying the invention and generally designated 30. It comprises an annular base flange 32 and an upward annular wall 34 formed about the inner perimeter of the annular base flange 32 (FIG. 4). At the top of the wall 34 an inward annular lip 36 is formed, and the wall is angled inwardly adjacent its top as at 38, and then downwardly in an inclined leading 40. The lip 36 defines an opening 42 which receives the top 16 of the head element 10 in snap passage.

It is clear that the head element 10 and the socket element 30 are each integrally molded parts, with their respective base flanges formed in the molding processes with the cross pieces 24 and top 16 on the one hand, and side wall 34 and inward lip 36 on the other hand.

Figure 5:
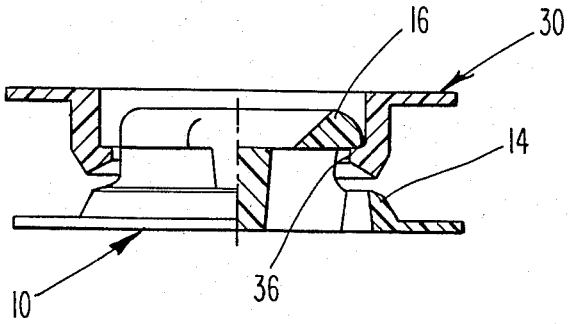
FIG. 5 is a view combining FIGS. 2 and 4 to show mated fastener elements.

FIG. 5 shows the head element 10 and the socket element 30 snapped together, with the lip 36 of the socket snapped passed beyond the perimeter of the top 16 so that the parts are mated together. As can be seen, the space between the top of the ring 14 and the underside of the top 16 permit the lip 36 up and down "play" so that the total height of the mated elements may be reduced as the parts are telescoped together as when any compressive force is applied, bringing the two base flanges toward each other.

DESCRIPTION OF MODIFIED FORM

Figure 6:
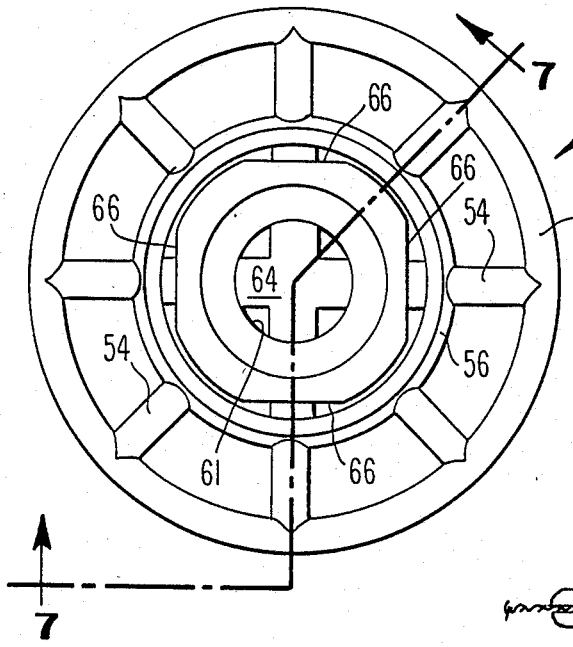
FIG. 6 is a top view of a modified form of head element embodying the invention.

A modified form of the fastener embodying the invention is generally designated 50 in FIG. 6. In this version the base flange, rather than being an imperforate annulus 12 in the above-described structure, is in the form of a wheel 52 having spokes 54 going into an inner ring 56 similar to ring 14 of the preferred embodiment. The "wheel" is split in a plane perpendicular to its axis.

In the molding process the perforated fabric F (FIG. 7) is disposed between the two halves of the wheel 52 so that it is mechanically clamped between the spokes. This embodiment is designed for use particularly where the plastic filaments of the fabric F are not compatible with the plastic of the fastener part 50. In this version, of course, there is no actual bonding of the plastic in the "wheel" with the plastic in the fabric F. Rather, the two halves of the wheel hold the fabric F firmly therebetween.

The remaining structure of the fastener head element 50 is similar to that of the version shown in FIGS. 1–5. For instance, the top 58 of the head is formed with a curved or rounded periphery 60 and the central opening 61 has an inwardly and downwardly inclined surface 62. The radial ribs are in the form of cross pieces 64 extending diametrically across the opening inside the ring 56 and extending up to the top 58 of the head, and support it in a plane parallel to the plane of the base wheel 52. As shown in FIG. 6, the top 60 is formed with the flats 66 adjacent the ends of the cross pieces 64, as has been explained in connection with the earlier embodiment. These flats and the reduced dimension of the cross pieces 64 in the area of the flats 66 assure that the on/off action is consistent irrespective of the angle of push on or pull off.

Figure 7:
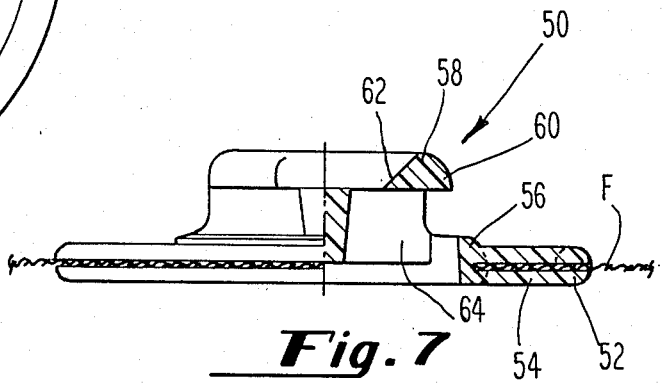
FIG. 7 is a sectional view taken on the line 7—7 of FIG. 6.
Figure 8:
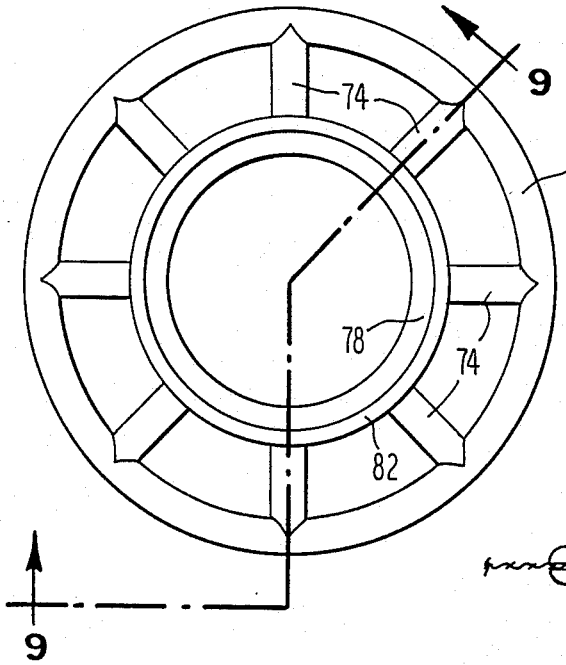
FIG. 8 is a top view of a modified form of socket embodying the invention.
Figure 9:
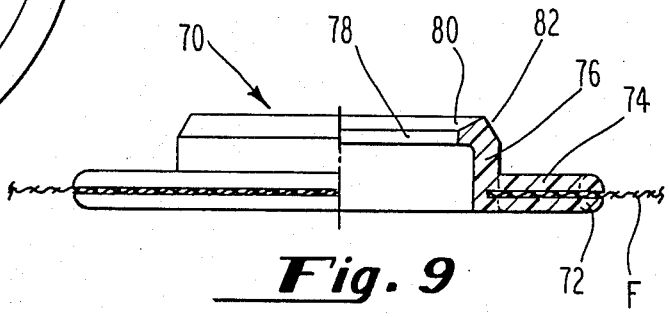
FIG. 9 is a sectional view taken on the line 9—9 of FIG. 8.

In FIG. 8 there is shown a socket element 70 in which the flange of the FIG. 3 embodiment is replaced by a wheel identical to the wheel of the head element shown in FIGS. 6 and 7. The wheel includes the rim 72 and the spokes 74, and as shown in FIG. 9 the "wheel" is split in a plane perpendicular to the axis of the wheel. As in FIG. 7 the fabric F is clamped between the two halves of the wheel. The inner perimeter of the wheel is provided with a ring which extends upward in a side wall 76. At its upper end the side wall 76 has the lip 78 which extends inwardly. An inclined lead-in 80 is formed and angles down from the top of the side wall 76. The upper outer corner of the side wall is chamfered at 82.

Figure 10:
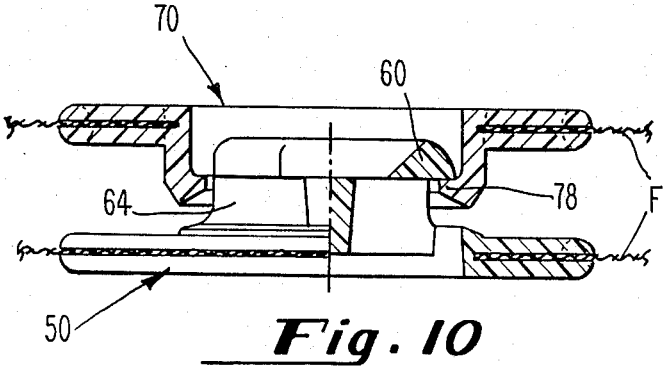
FIG. 10 is a view incorporating FIGS. 7 and 9 and showing mated fastener elements.

FIG. 10 shows the two parts of the modified form of the invention mated together, the inward lip 78 of the socket 70 snapping over the top 60 of the head element 50. As with the earlier embodiment, the height of the cross pieces 64 provides ample vertical "play" of the two parts so that they can telescope together upon encountering any vertical compressive force.

It should be clear from the above that the embodiments shown offer a snap fastener readily adapted for use with various kinds of disposable fabric. Preferably to assure a proper binding, the plastic of the fastener parts is the same as the plastic of at least some filaments of the fabric F. For example, where the fabric is composed of polypropylene filaments, the plastic of the fastener elements may be polypropylene as well. This carries on. The nylon fabric would call for nylon as the plastic for the elements. Such identity of plastic in the fastener parts and the fabric would make the FIGS. 1–5 embodiment practical. Where the plastic of the fabric is not the same as or compatible with the fastener plastic, then the second embodiment of FIGS. 6–10 is preferred as explained.

It should be observed that the formation of the head element is the same except for the attaching means (the solid flange 12 or the wheel-shaped flange 52). In both embodiments, the head element is always characterized by ribs, preferably the cross piece as shown. The ribs support the head top which is flattened, i.e., reduced in radial dimension adjacent the ends of the cross pieces. This structure assures consistent on/off force irrespective of the angle from which the force is directed. This is because the socket does not engage the head in the area where the head is stiffened by the cross piece; it is only the round arcuate rim portions of the top head which engage the socket lip during on or off actions. The resiliency of the head in these portions is constant.

DESCRIPTION OF THE APPARATUS FOR MAKING THE PRODUCT

Figure 11:
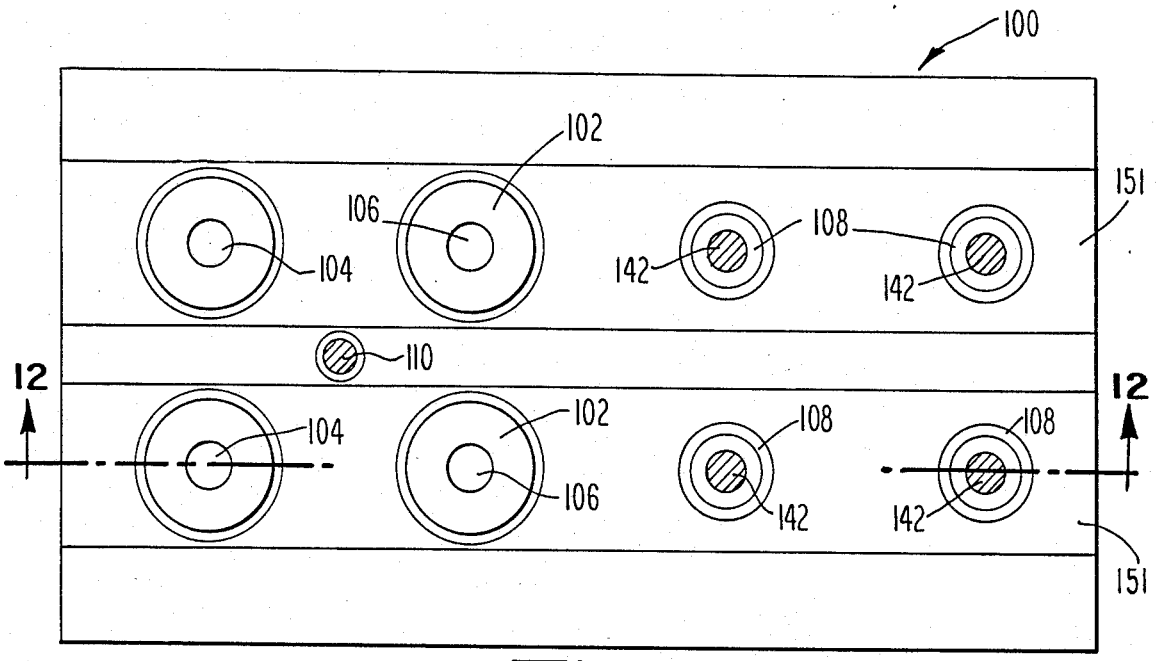
FIG. 11 is a view taken on the plane of the line 11—11 of FIG. 12 and showing the open face of the top mold plate.

The top mold retainer plate of an apparatus embodying the invention is generally designated 100 in FIG. 11. It holds the mold inserts 102 and 103 which have central cavities 104 for making the head element and 106 for making the socket element. Also provided in the mold retainer plate are sleeves 108 which provide the shearing annulus for perforating the fabric.

A sprue ejection pin 110 is provided and extends from below, as viewed in the figures, through the plates of the mold toward the sprue cavity 112. Sprue cavity 112 has runners 114 leading to the mold cavities 104 and 106. For simplicity only the runner to cavity 104 is shown.

Figure 12:
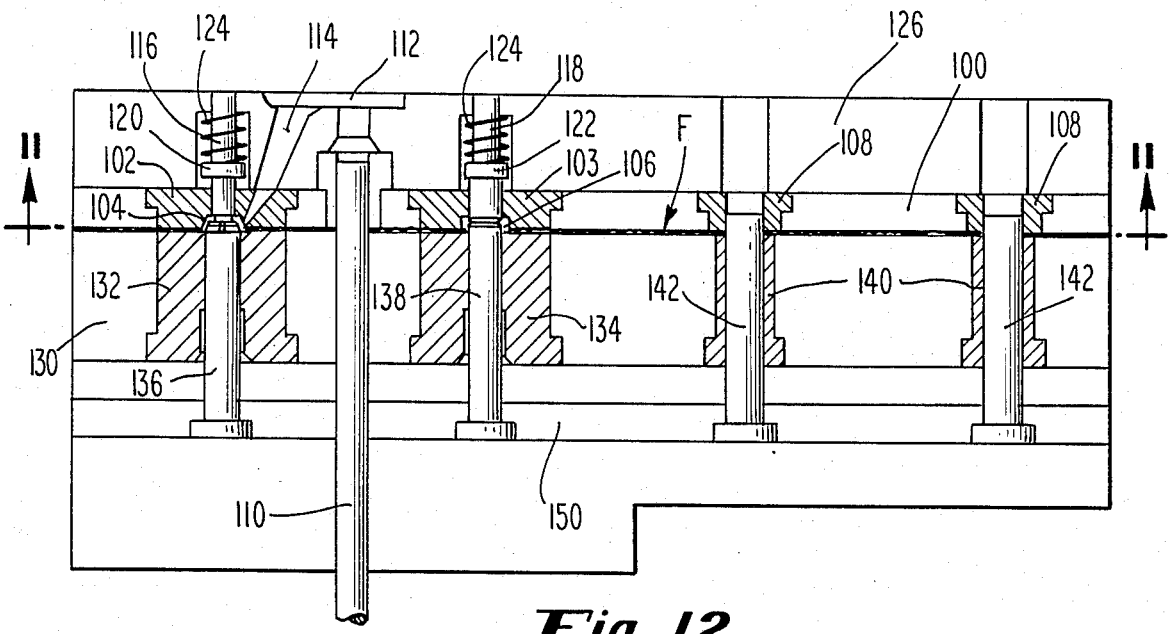
FIG. 12 is a sectional view of the apparatus and taken on the line 12—12 of FIG. 11 and showing the fabric disposed between the mold faces an parts in position for the injection of plastic.

Referring further to FIG. 12, the inserts 102 and 103 are formed respectively with ejection pins 116 and 118, which are provided with stops 120 and 122 which engage the upper end of the inserts 102 and 103 at the downward end of their travel. Springs 124 bias the ejection pins downwardly. A backing plate 126 is provided the sprue and runner cavities as described and with suitable cavities to house the ejection pins 116 and 118, and provide a back-up for the springs 124.

The lower mold retaining plate 130 includes the lower inserts 132 and 134. These are provided with shallow mold cavities at their upper end and permit the passage of the core pins 136 and 138. The core pins are secured to a lower backing plate 150 and held in a way that their radial orientation cannot be disturbed.

The lower mold retaining plate 130 is also provided with bushings 140, which are aligned with the sleeves 108 in the upper mold and permit the passage of the punches 142, which cooperate with the sleeves 108 during the closing of the press to perforate the fabric F. The lower backing plate 150 also firmly holds the punches 142 as well as the core pins 136 and 138.

Figure 13:
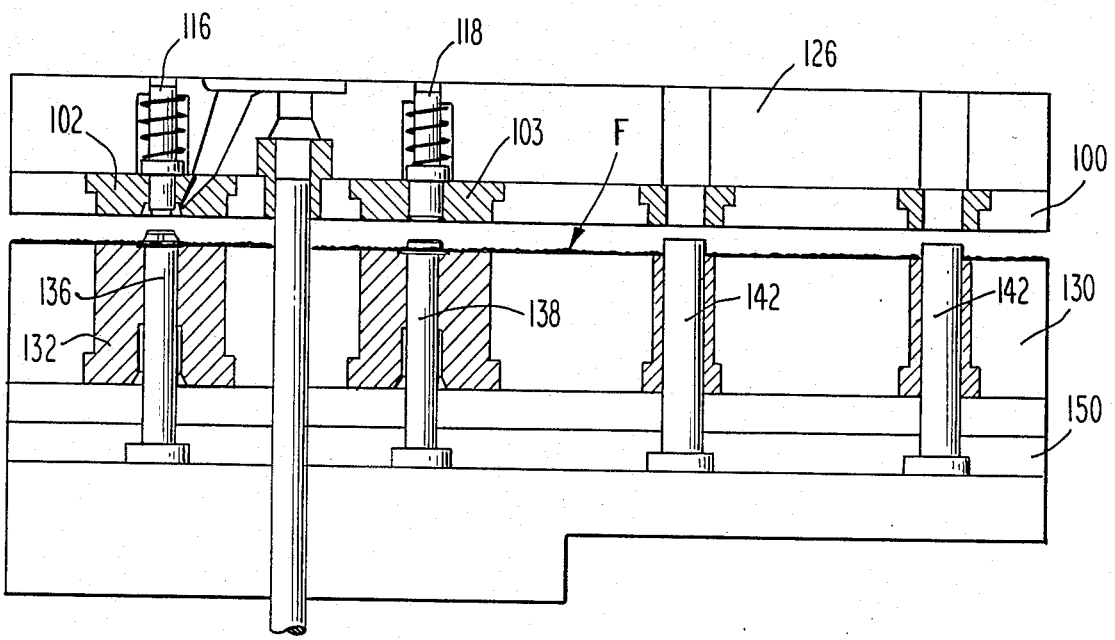
FIG. 13 is similar to FIG. 12 but showing the mold open with the core pins and ejection pins extended.
Figure 14:
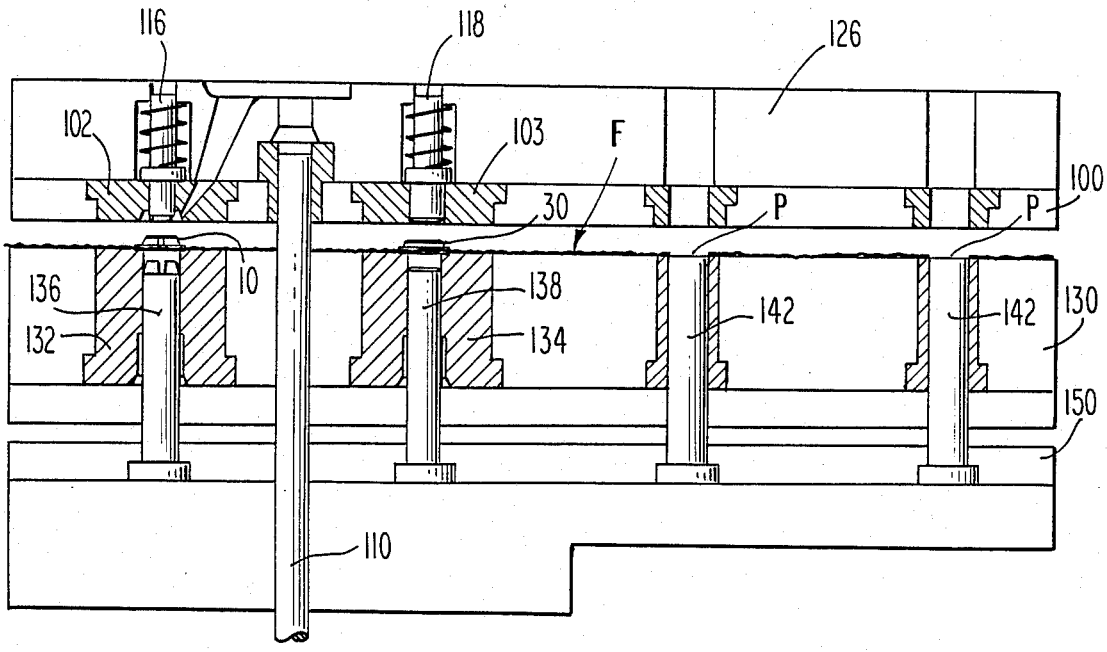
FIG. 14 is similar to FIG. 13 but showing the core pins and punches retracted and the fabric free to move on to its next station.

FIGS. 12, 13 and 14 show the mold at successive stages of its operation.

OPERATION OF THE APPARATUS

The mold shown in FIGS. 12–14 are for making two fabric tapes each having a row of alternating head-and-socket elements molded thereon. Shallow side-by-side recesses 152 running the length of the plate 130 accommodate the tape.

In closing the mold, as shown in FIG. 12, with the lower backing plate 150 tight against the molding plate 130, the upper ends of the punches 142 perforate the fabric as the punches work against sleeves 108. (As will be understood, the fabric is stepped along leftwardly before each successive closing of the mold so that the perforations P of the previous mold closing are lined up with the mold cavities in the inserts 132 and 134 on the next mold closing. The fabric F of the disclosure is in the form of two separate tapes which ride in shallow recesses 151 in the lower retaining plate 30.)

In the mold closing the core pins 136 and 138 extend into the mold cavities and engage the respective ejection pins 116 and 118. These engaged core pins 136, 138 and ejection pins 116, 118, in combination with the cavities formed in the inserts 132, 134 and 102, 103 comprise the full cavity molds for the socket and head elements respectively.

With the mold in the closed condition shown in FIG. 12, plastic is shot from the injection molding machine head into the sprue chamber 112 and into runners 114 to fill the respective mold cavities 104 and 106 with plastic.

Figure 15:
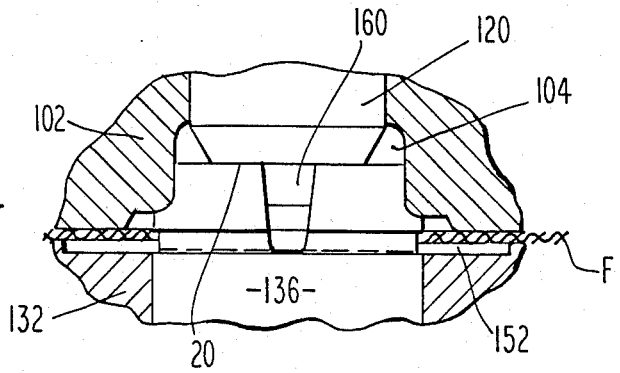
FIG. 15 is an enlarged fragmentary view, partly in section, showing the core pin and the ejection pin in the mold cavity for forming a stud head element.

As can be seen in FIG. 15, the top of the core pin 138 is formed with a cross-cut 160 which, when the mold is filled with plastic, becomes the cross piece 24 on the head element. By having the ejection pin 122 impinge on the top of the core pin 138, the central opening 20 (FIG. 2) in the head element is formed. The shallow flange cavity 152 part of cavity 104 in the top of the insert 132 is beneath the parting line of the mold on which the fabric F is located. Hence, the flange 12 is molded into the underside of fabric F. The deeper upper cavity, also part of cavity 104, shape the upper portion of the head element.

By the same token, the cavities in the insert 103 and insert 134, plus the engaging ejection pin 116 and core pin 136, form the socket having the central opening 42 where the pins engage.

After the plastic is cured, the mold is opened. As shown in FIG. 13, the mold retaining plates 130 and 100 part. As the core pins 136 and 138 withdraw from plate 100 the ejection pins 116 and 118 move downward until the stops 120 and 122 respectively hit the top side of the inserts 102 and 103. This movement downward of the ejection pins pops the plastic products downward out of the upper part of the mold cavity, and the finished product with the attached fabric F sits on the top of the core pins 136, 138 (FIG. 13).

Subsequently the backing plate 150 is lowered and the core pins 136 and 138 move downward, breaking away from the plastic snap fastener products which are now molded on to the fabric F, products 30 and 10 respectively. At the same time, the punches 142 drop and the perforations P are no longer impaled by the punches 142 as they were in the FIG. 13 condition.

The entire fabric F assembly is now free to be moved leftwardly with respect to the press until the perforations P align with the mold cavities 104 and 106 in inserts 102 and 103 and inserts 132 and 134, ready for the next molding operation.

At some point (FIG. 13) in the above sequence the sprue ejection rod 110 drives up against the sprue 112 driving it, including the runners 114, out of the mold to drop in the waste bin.

The product thus produced is a pair of tapes having alternate snap fastener head-and-socket elements. Such a product finds ample use when bonded to or stitched to disposable clothing, for instance.

The invention thus described affords a molded snap fastener head-and-socket element and apparatus for molding it and simultaneously attaching it to a disposable fabric. Clearly the invention is susceptible to many modifications and variations beyond those disclosed, and it is therefore to be understood that the invention may be broadly defined as in the following claim language including appropriate equivalents thereof.

We claim:

1. A molded snap fastener head comprising an annular base flange having a central opening and an upwardly extending ring on the flange about the central opening, a generally annular head top also having a central opening, the top being spaced above and parallel to the flange, radial ribs disposed within the central opening of the flange and extending upward to support the top, the outer ends of the ribs and the adjacent periphery of the top being reduced in dimension in directions radial of the fastener head so as to not interfere with the action of a mating socket.

2. A molded snap fastener head as claimed in claim 1 wherein the central opening in the top is inclined inward and downward.

3. A molded snap fastener head as claimed in claim 1 wherein the outer perimeter of the top of the fastener is rounded for smoother entry into a mating socket.

4. A molded snap fastener head as claimed in claim 1 wherein a plastic-containing fabric is molded onto the top surface of the base flange and the fabric is perforated and the ribs and top extend up through the perforation.

5. A molded snap fastener head as claimed in claim 4 wherein the plastic of the head and the plastic of the plastic-containing fabric are the same.

6. An integral one-piece molded snap fastener head comprising a pair of spaced annular base flanges each having a central opening and an upwardly extending ring on the lower flange connecting the two flanges about the central opening, a generally annular stud head top also having a central opening, the top being spaced above and parallel to the flanges, radial ribs disposed within the central opening of the flanges and extending upward to support the top, the ends of the ribs and the adjacent periphery of the top being reduced in dimension in directions radial of the fastener head so as to not interfere with the action of a mating socket, the flanges having aligned windows therein extending from the central opening outward, the flanges being adapted to secure a fabric layer between them.

7. A molded snap fastener head as claimed in claim 6 wherein the flanges are each generally in the shape of a wheel having the rib as a central circular hub, radial spokes extending outward therefrom and connected to a rim at the perimeter of each flange.

8. A molded snap fastener head as claimed in claim 6 wherein the central opening in the top is inclined inward and downward.

9. A molded snap fastener head as claimed in claim 6 wherein the outer perimeter of the top of the fastener is rounded for smoother entry into a mating socket.

10. A molded snap fastener head as claimed in claim 6 wherein a perforated fabric layer is disposed between the base flanges.

11. A molded snap fastener head comprising an annular base flange having a central opening and an upwardly extending ring on the flange about the central opening, a generally annular head top also having a central opening, the top being spaced above and parallel to the flange, radial ribs extending outward from the axis of the head and disposed within the central opening of the flange and extending upward to support the top, the outer ends of the ribs and the adjacent periphery of the top being reduced in dimension in directions radial of a mating socket.

12. A molded snap fastener head as claimed in claim 11 wherein a plastic-containing fabric is molded onto the top surface of the base flange and the fabric is perforated and the ribs and top extend up through the perforation.

13. A molded snap fastener head comprising an annular base flange having a central opening and an upwardly extending ring on the flange about the central opening, a generally annular head top also having a central opening, the top being spaced above and parallel to the flange, radial ribs disposed within the central opening of the flange and extending upward to support the top, the ribs being connected at their inner ends, the outer ends of the ribs and the adjacent periphery of the top being reduced in dimension in directions radial of the fastener head so as to not interfere with the action of a mating socket.

14. A molded snap fastener head as claimed in claim 13 wherein a plastic-containing fabric is molded onto the top surface of the base flange and the fabric is perforated and the ribs and top extend up through the perforation.

* * * * *